US007291101B2

(12) United States Patent
Deal

(10) Patent No.: US 7,291,101 B2
(45) Date of Patent: Nov. 6, 2007

(54) EXERCISER AND MASSAGER APPARATUS

(76) Inventor: Clifton Deal, 1379 B. Curtis Switch Rd., Mineral Bluff, GA (US) 30559

( * ) Notice: Subject to any disclaimer, the term of this patent is extended or adjusted under 35 U.S.C. 154(b) by 134 days.

(21) Appl. No.: 11/039,393

(22) Filed: Jan. 20, 2005

(65) Prior Publication Data

US 2005/0202944 A1 Sep. 15, 2005

Related U.S. Application Data

(60) Provisional application No. 60/538,129, filed on Jan. 21, 2004.

(51) Int. Cl.
*A63B 21/00* (2006.01)

(52) U.S. Cl. ..... 482/126; 482/121; 601/125; 601/120

(58) Field of Classification Search ..... 482/121, 482/126, 148; 601/125, 120
See application file for complete search history.

(56) References Cited

U.S. PATENT DOCUMENTS 192,338 A * 6/1877 Marshal ..... 482/126
1,533,528 A * 4/1925 Weaver ..... 601/118
3,544,106 A * 12/1970 Barrett ..... 482/126
3,991,510 A * 11/1976 Bytheway ..... 446/489
4,433,683 A * 2/1984 McCoy et al. ..... 601/120
4,712,539 A * 12/1987 Kim ..... 601/120
5,741,207 A * 4/1998 Buoni et al. ..... 482/124
6,135,972 A * 10/2000 Kuo ..... 601/119
6,241,693 B1 * 6/2001 Lambden ..... 601/15

* cited by examiner

*Primary Examiner*—Jerome Donnelly
(74) *Attorney, Agent, or Firm*—Clifford Kraft

(57) ABSTRACT

An exercise device that has a shaft containing one or two rollers that are free to slide on the shaft. The shaft can be shaped near a semi-circle or can be normally straight and bent elastically to a near semi-circle. When the normally straight shaft is bent, it can be held by an elastic cord like a bungee cord. The invention can also be a small unit with one or more (preferably two) rollers that are held together by a pair of handles. For all embodiments, optional springs can connect the handles to the shaft.

9 Claims, 4 Drawing Sheets

EXERCISER AND MASSAGER APPARATUS

This application is related to and claims priority from U.S. provisional application No. 60/538,129 filed Jan. 21, 2004. Application 60/538,129 is hereby incorporated by reference.

BACKGROUND

1. Field of the Invention

This invention relates in general to the field of personal exercise and in particular to a roller exerciser and massager apparatus.

2. Description of the Prior Art

There are many exercise devices known in the art, and there are massagers that are used in contract with the skin. However, many of these devices are bulky and expensive. In addition, many of the devices on the market, or known in the art, are actually dangerous in the sense that they can cause damage to bones or muscles.

It would be advantageous to have an exerciser/massager device that is safe, easily and cheaply constructed, but sturdy, that exercises different muscles and allows toning and weight loss in a safe simple manner.

Figure 1:
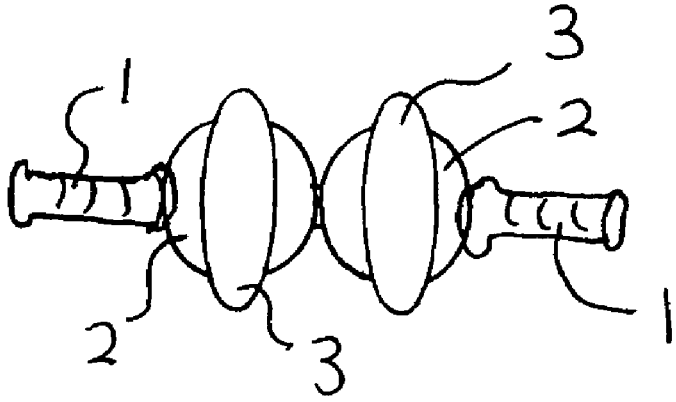
FIG. 1 shows a short-handled embodiment of the exerciser massager.

Several illustrations have been presented to aid in the understanding of the present invention. The scope of the present invention is not limited to what is disclosed in the drawings.

DETAILED DESCRIPTION OF THE INVENTION

FIG. 1 shows a short-handled embodiment of the present invention. A straight shaft about 0.75 inches in diameter can be configured with rubber grips 1 on each end. The grips can be about 4.5 inches long and about 1 inch in diameter. The entire shaft can be about 17–18 inches long. Side-by-side in the center of the shaft between the two grips are two roller wheels around 5 inches in diameter with flat curved sides 2 and rolling surfaces 3. These wheels can be shaped with a flat, or approximately flat, rolling surface around their center circumference, or they can be dumbbell shaped or any other shape. When the device is held in both hands with one hand holding each grip, it can be rolled across any surface of the body. It is especially effective across the back, across the back of the legs and up and down the legs. The user simply rolls it forward, backward, and side to side. The user can control the degree of the workout by rolling further or closer. The device can be used to slim and shape waist, abdominal, chest, arm, back and shoulder muscles. The comfort grip handles 1 lead to stability and ease of handling. People of any age can use the device effectively either to exercise or for a relaxing massage. The grips can be made of soft rubber and the wheels can be made of plastic. While these are the preferred materials, the present invention can be made from any semi-rigid or rigid material.

Figure 2:
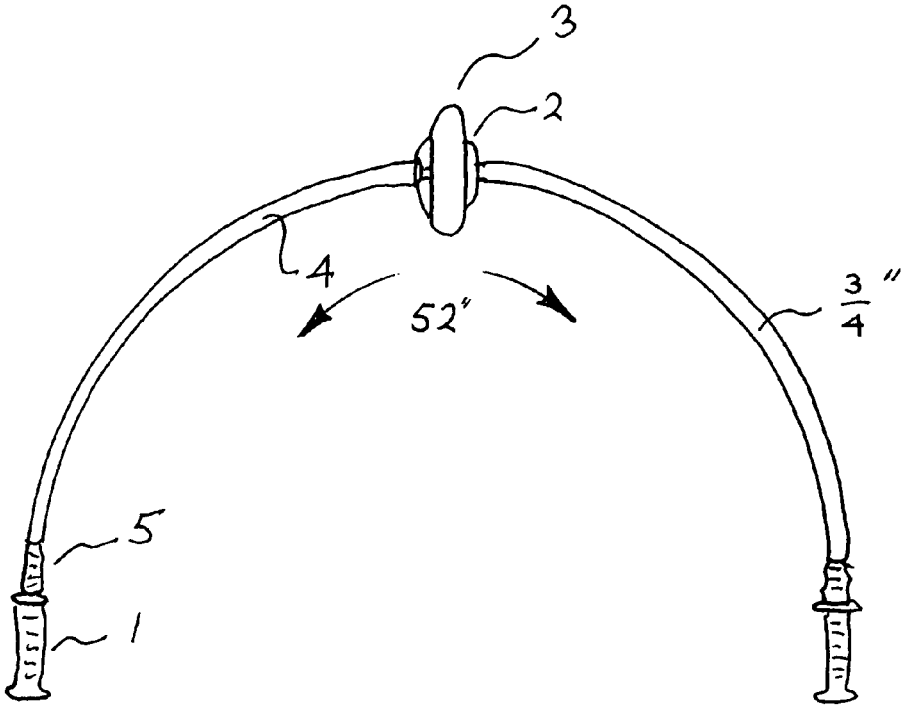
FIG. 2 shows a long-handled embodiment of the exerciser massager.

FIG. 2 shows a long-handled embodiment of the present invention. Here a long curved near semi-circular shaft of about 0.75 inches in diameter 4 can be attached to handles 1 through a pair of bumper springs 5. A single wheel (or multiple wheels or rollers)with a face 2 and a rolling surface 3 can be mounted in the center of the arc. The wheel or roller is normally free to move or slide along the arc of the shaft. The preferred semi-circumference or length of the shaft is around 52 inches. The wheel can be around the same diameter as the wheels in FIG. 1. The exact shape does not have to be that of a semi-circle, but rather can be any convenient shape.

Figure 3:
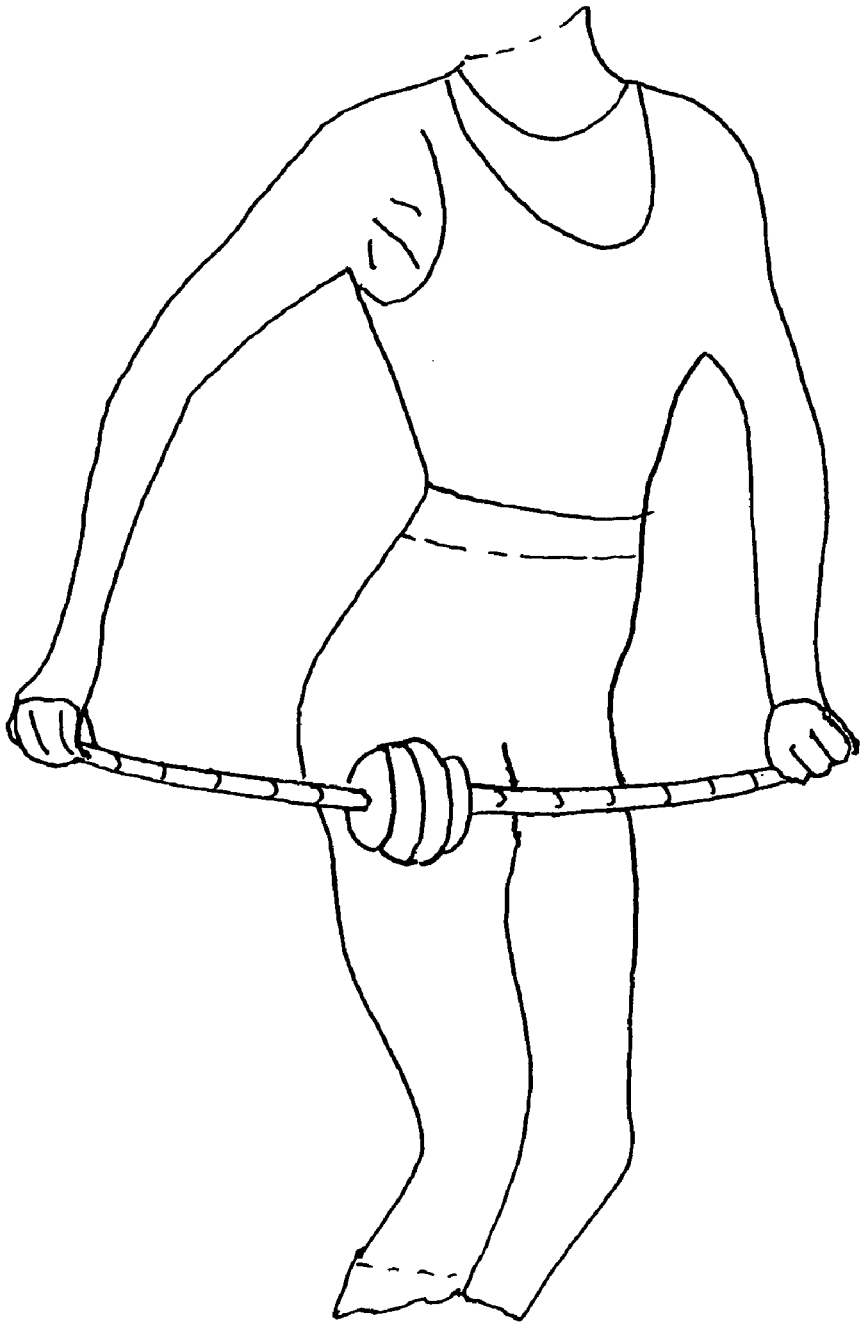
FIG. 3 shows an example of how the long handled exerciser massager can be used to tone up muscles and lose weight.

FIG. 3 shows how the embodiment from FIG. 2 can be used to exercise and tone. The device can also be used to massage sore muscles. The user can exercise many different ways and in many different positions with the present invention. FIG. 3 is an example of one of these ways.

Figure 4:
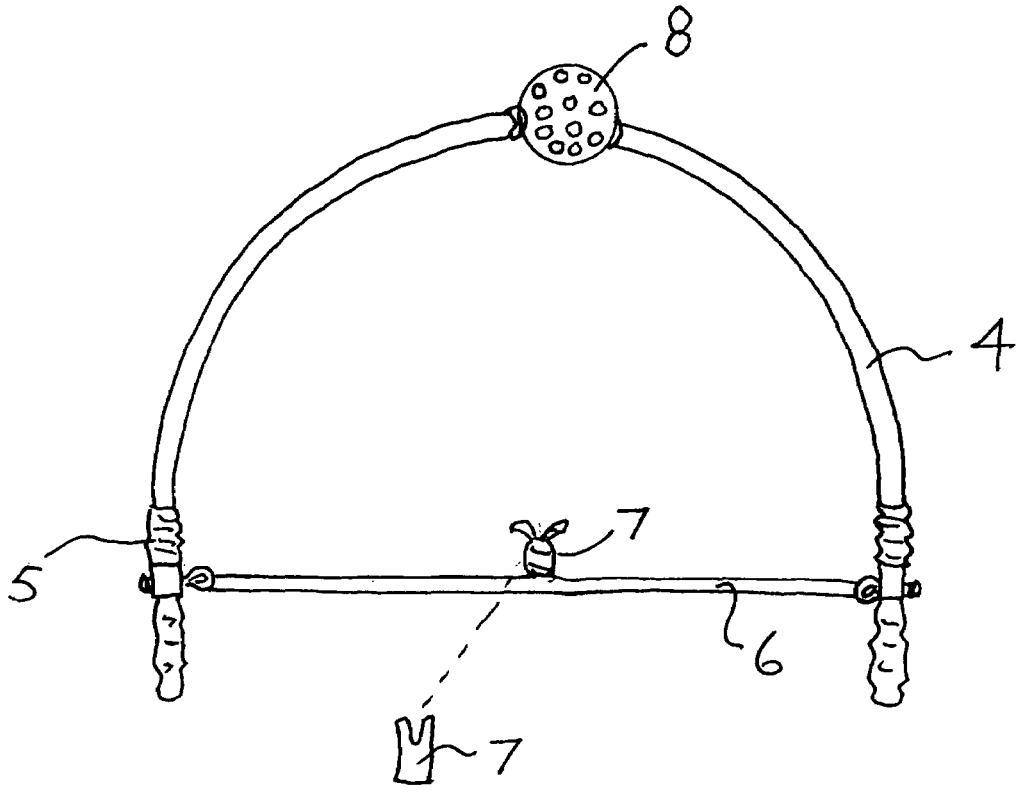
FIG. 4 shows an alternate embodiment of the invention that uses a bungee cord.

FIG. 4 shows an alternate embodiment of the present invention. A pair of handles 1 which can resemble bike grips can be attached to a round, elongated shaft 4 with optional compression springs 5. The shaft 4 can be bent elastically to form a semi-circle and held in that configuration elastically by a piece of adjustable bungee cord 6. The bent shaft can elastically pull outward against the elasticity of the bungee cord. The bungee cord 6 can be held and adjusted with a clip 7. It should be possible to tighten or loosen the bungee cord with the clip. A ball 8, or roller, which can be made of plastic or other suitable material is located near the center of the semi-circle on the shaft 4. The ball 8 should be free to independently rotate on the shaft and to slide. In use, this embodiment of the present invention is used like the embodiment of FIG. 2 except that in this embodiment, the otherwise straight shaft is kept in an adjustable position somewhere near a semi-circle by the bungee cord. The device is placed over the user's head and used in a manner similar to that shown in FIG. 3. It can be used on the back, legs, shoulders or other parts of the body.

Several descriptions and illustrations have been presented to aid in the understanding of the present invention. It will be understood by one skilled in the art that many changes and variations are possible. All of these changes and variations are within the scope of the present invention.

I claim:

1. A method of exercising comprising the steps of:

holding a curved shaft with a roller element on said shaft against a body part of a user, said roller element being able to roll and slide on said shaft, said shaft having handles; and wherein said shaft is held in the shape of a semi-circle by an elastic cord;

causing said roller element to roll over said body part for muscle toning and exercise.

2. The method of claim 1 wherein said roller is dumbbell shaped.

3. The method of claim 1 wherein said roller is a ball.

4. The method of claim 1 further comprising a second roller on said shaft.

5. The method of claim 4 wherein said rollers are held together by said handles.

6. An apparatus for exercising comprising a normally straight shaft held in the bent shape of near a semi-circle by an elastic cord, said shaft having roller member on it that can rotate and slide on said shaft, said shaft attached to a pair of handles, one on each end through compression springs.

7. A method of exercising comprising the steps of:

holding a curved shaft with a roller element on said shaft against a body part of a user, said roller element being able to roll and slide on said shaft, said shaft having handles; and wherein said shaft is held in an arcuate shape by an elastic member;

causing said roller element to roll over said body part for muscle toning and exercise.

8. The method of claim 7 wherein said roller is dumbbell shaped.

9. The method of claim 7 wherein said roller is a ball.

* * * * *